US007312577B2

(12) United States Patent
Woo et al.

(10) Patent No.: US 7,312,577 B2
(45) Date of Patent: Dec. 25, 2007

(54) DESIGN FOR PLASMA DISPLAY PANEL RESULTING IN IMPROVED LIGHT EMISSION EFFICIENCY

(75) Inventors: Seok-Gyun Woo, Ahsan-si (KR); Kyoung-Doo Kang, Seoul (KR); Woo-Tae Kim, Yongin-si (KR); Hun-Suk Yoo, Cheonan-si (KR); Jae-Ik Kwon, Ahsan-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 245 days.

(21) Appl. No.: 10/873,489

(22) Filed: Jun. 23, 2004

(65) Prior Publication Data

US 2005/0001549 A1 Jan. 6, 2005

(30) Foreign Application Priority Data

Jul. 3, 2003 (KR) ..... 10-2003-0044860

(51) Int. Cl.
*H01J 17/49* (2006.01)

(52) U.S. Cl. ..... 313/586; 313/582; 313/584; 313/587

(58) Field of Classification Search ..... None
See application file for complete search history.

(56) References Cited

U.S. PATENT DOCUMENTS 6,566,812 B1 * 5/2003 Torisaki et al. ..... 313/586

FOREIGN PATENT DOCUMENTS

| | | | |
|---|---|---|---|
| JP | 11096922 A | * | 4/1999 |
| JP | 11-204044 | | 7/1999 |
| JP | 11317170 A | * | 11/1999 |
| JP | 2000260330 | * | 9/2000 |
| JP | 2000260330 A | * | 9/2000 |
| JP | 2002-304948 | | 10/2002 |
| KR | 20010093724 | | 10/2001 |

* cited by examiner

*Primary Examiner*—Sikha Roy
(74) *Attorney, Agent, or Firm*—Robert E. Bushnell, Esq.

(57) ABSTRACT

A plasma display panel with first and second substrates facing each other, and address electrodes formed on the second substrate. A partition wall is disposed between the first and the second substrates to separately partition a plurality of discharge cells. A phosphor layer is formed within each discharge cell. Discharge sustain electrodes are formed on the first substrate. A thickness of the phosphor layer is designed so that the resulting internal space has a shape corresponding to the diffusion shape of the plasma discharge generated within the discharge cell to optimize brightness of the image and to maximize light emission efficiency.

19 Claims, 4 Drawing Sheets

DESIGN FOR PLASMA DISPLAY PANEL RESULTING IN IMPROVED LIGHT EMISSION EFFICIENCY

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on 3 Jul. 2003 and there duly assigned Serial No. 2003-0044860.

BACKGROUND OF THE INVENTION

1. Field of the Invention

The present invention relates to a plasma display panel, and in particular, to a design for a phosphor layer in a plasma display panel that maximizes light emission efficiency and screen brightness.

2. Description of Related Art

Generally, a plasma display panel (simply referred to hereinafter as a "PDP") is a display device which produces a discharging gas which produces vacuum ultraviolet rays which then interacts with a phosphor layer to produce visible light to display desired images. The PDP makes it possible to provide both a high resolution display and a wide-screen display. PDPs thus are now in the spotlight for being a future generation of flat panel displays.

The PDP is largely classified into an AC type, a DC type, and a hybrid type. It is common to use an AC type triple-electrode face discharge structure. With the AC type triple-electrode face discharge structure, an address electrode, a partition wall, and a phosphor layer are formed on a rear substrate corresponding to each discharge cell, and a discharge sustain electrode with a scanning electrode and a display electrode is formed on a front substrate. Often, the front substrate is made to be optically transparent so that the visible images produced in the display can be viewed by a user through the front substrate. The discharge cell is filled with a discharge gas (a mixture of Ne and Xe).

When signals are applied to the address electrodes and the scanning electrodes when selecting the discharge cells for emitting light, and voltages of 150~200V are applied to the scanning electrodes and the display electrodes, the discharge gas induces a plasma discharge, and vacuum ultraviolet rays with wavelengths of 147 nm, 150 nm, and 173 nm are discharged from excited Xe atoms generated during the plasma discharge. These vacuum ultraviolet rays are used to excite phosphors in the phosphor layer to generate visible rays, thereby displaying desired color images.

With the above-structured PDP, the energy efficiency of the device is reduced by numerous factors. The multiple sources of energy loss occur at each step in the conversion of an electrical voltage to the production of visible images. FIG. 6 schematically illustrates the total light emission efficiency (T) of the PDP is the sum of the energy efficiencies for each of the five steps (1) through (5). The total light emission efficiency (T) of the PDP is illustrated as the sum of (1) the circuit efficiency due to the circuit loss, (2) the discharge efficiency when the discharge power is converted into ultraviolet rays, (3) the ultraviolet utilization rate when the ultraviolet rays are converted into effective ultraviolet rays, (4) the phosphor efficiency when the effective ultraviolet rays are converted into visible rays, and (5) the visible ray utilization rate when the visible rays are converted into display light.

Many efforts have been made to minimize the energy loss at the respective steps of designing and manufacturing the PDP. All the above-identified efficiencies except for (1) the circuit efficiency are mainly affected by the internal structure and the material characteristics of the PDP. Therefore, there has been a great deal of research related to improving the internal structure and material characteristics of the PDP to improve the energy efficiencies of (2) through (5) above.

Regarding the internal structure of a PDP, the partition walls for the PDP are generally classified into either a stripe-like open type or a rectangle-like closed type. The rectangle-shaped closed type partition wall independently partitions the respective discharge cells to prevent inter-cell cross-talk, while increasing the phosphor-coated area. With both the stripe-shaped partition wall and the rectangle-shaped partition wall, the phosphor layer is formed through printing, drying, and sintering the phosphors.

Compared to the PDP with the stripe-shaped partition wall, the PDP with the rectangle-shaped partition wall results in an increased phosphor-coated area, thereby improving the phosphor efficiency (4) and the visible ray utilization rate (5). However, the phosphor layer is coated without considering the light emission efficiency (T) of the PDP, and hence, the optimized design for optimum light emission efficiency (T) is not realized.

Particularly with the PDP having a rectangular partition wall, the plasma discharge generated at each discharge cell is diffused from the space between the scanning electrode and the display electrode toward the periphery of the discharge cell in the shape of an arc. However, as the conventional phosphor layer is patterned irrespective of the diffusion shape of the plasma discharge, there are limits to improving the light emission efficiency (T) and the screen brightness.

SUMMARY OF THE INVENTION

It is therefore an object of the present invention to provide an improved design for a PDP.

It is also an object of the present invention to provide a design for a PDP that maximizes the light emission efficiency of a PDP.

It is further an object of the present invention to provide a design for a PDP that improves the light emission efficiency of a PDP.

It is yet another object of the present invention to provide a PDP that optimizes light emission efficiency of a PDP by modifying a thickness and profile of a phosphor layer in a discharge cell in a PDP.

It is still another object of the present invention to provide a PDP with an optimized internal space shape that is optimized by varying the thickness profile of the phosphor layer within the discharge cell.

It is still an object of the present invention to optimize a phosphor layer pattern in consideration of the diffusion shape of the plasma discharge generated within the discharge cell.

These and other objects may be achieved by a PDP with rectangular closed partition walls defining discharge cells, the discharge cells having a phosphor layer whose thickness throughout the discharge cell is controlled and optimized so that the thickness of the discharge cell matches the arc-shaped diffused plasma discharge. The PDP includes first and second substrates facing each other, and address electrodes formed on the second substrate. A partition wall is disposed between the first and the second substrates to separately partition a plurality of discharge cells. A phosphor layer is formed within each discharge cell. Discharge sustain electrodes are formed on the first substrate. The phosphor layer has a shape corresponding to the diffusion shape of the plasma discharge generated within the discharge cell.

A dielectric layer is formed on at least a portion of the second substrate while covering the address electrodes. The partition wall is formed on the dielectric layer, and is the plasma display panel includes discharge cells defined by the partition wall having a pair of long portions, a pair of short portions, and connecting portions connected therebetween.

The phosphor layer is formed on the inner sides of the partition wall and the top surface of the dielectric layer. The phosphor layer has a bottom portion contacting the surface of the dielectric layer, and a wall portion contacting the long, short and connecting portions of the partition wall. The plane shape (or cross-sectional shape) of an internal space surrounded by the wall portion of the phosphor layer within the discharge cell corresponds to the diffusion shape of the plasma discharge generated within the discharge cell. The plane shape of the wall portion corresponding to at least one of the pairs of the long and short portions and the connecting portions of the partition wall is substantially formed with an arc.

The wall portion of the phosphor layer is structured to satisfy the following condition:

$$1.5 \leqq B/A \leqq 3.2$$

where A indicates the average thickness of the middle sub-portion of the wall portion contacting the long portions of the partition walls, and B indicates the average thickness of the middle sub-portion of the wall portion contacting the connecting portions of the partition walls. The thickness of the bottom portion of the phosphor layer is 9~25 μm. In the above formula, the value of A is in the range of 10~35 μm, and the value of B is in the range of 15~60 μm.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
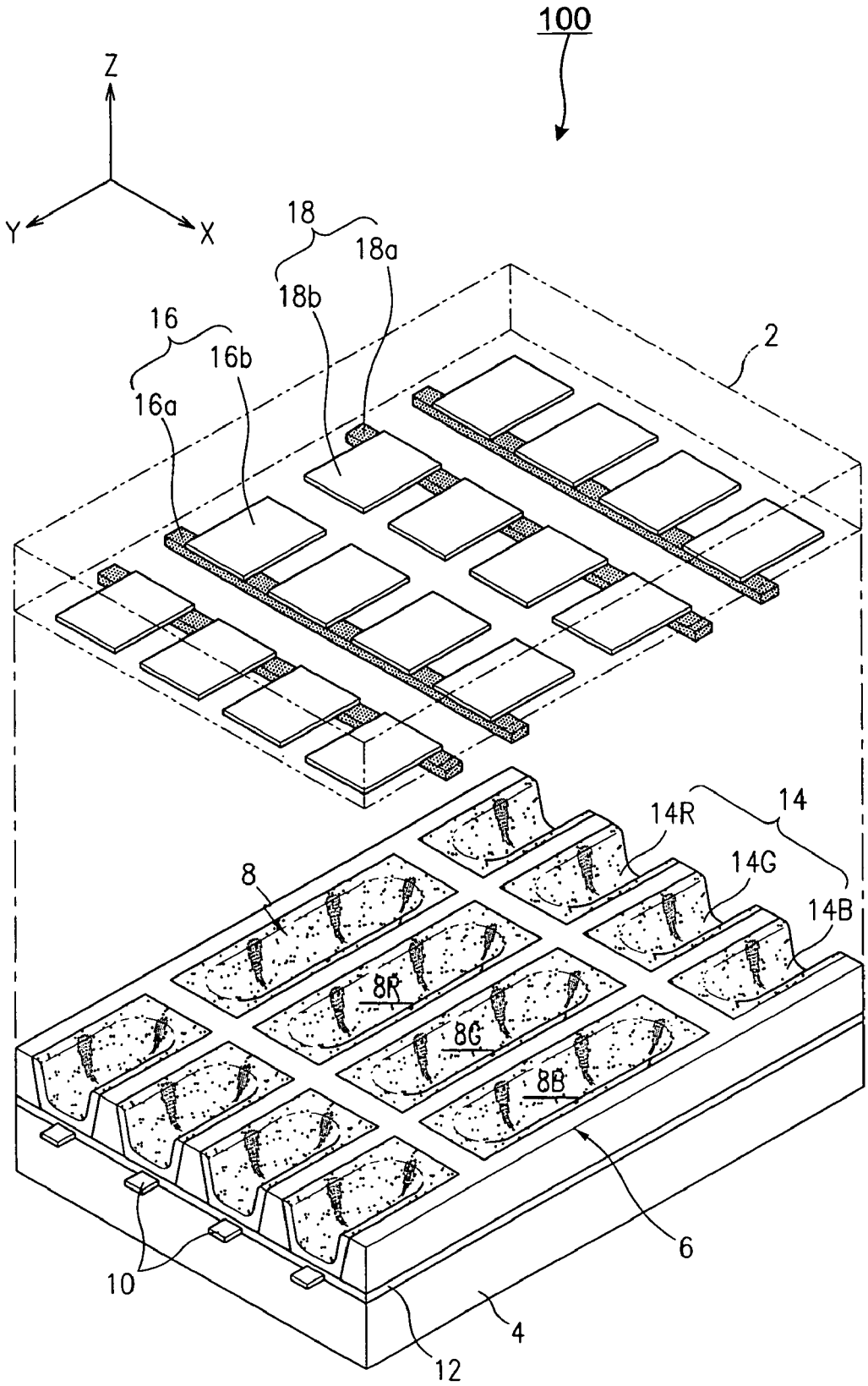
FIG. 1 is a partial exploded perspective view of a PDP according to an embodiment of the present invention.

As illustrated in the drawings, the PDP 100 has a first substrate (or a front substrate) 2, a second substrate (or a rear substrate) 4 facing the first substrate 2 while being spaced apart from the first substrate 2 by a predetermined distance, and discharge cells 8 (8R, 8G and 8B) provided between the first and the second substrates 2 and 4. Each discharge cell 8 is defined by a partition wall 6 formed between the substrates 2 and 4. Each discharge cell 8 emits visible rays with an independent discharge mechanism, thereby displaying the desired color image. In the figures, reference numeral 17 is the internal space for each discharge cell 8. The discharge cell 8 refers to the internal space 17 plus the space occupied by the phosphor layer 14 while the internal space 17 does not include the space occupied by the phosphor layer 14 but instead only includes the space occupied by a discharge gas.

Now focusing on the specifics of the PDP 100, address electrodes 10 are formed on the inner surface of the second substrate 4 in a +/−y-direction. A dielectric layer 12 is formed on at least a portion of the second substrate 4. Dielectric layer 12 covers address electrodes 10. The address electrodes 10 may be formed with a stripe pattern as illustrated in FIG. 1. In FIG. 1, the address electrodes 10 are arranged in parallel to each other and are offset or separated from each other by a predetermined distance.

The partition wall 6 is formed on the dielectric layer 12 on second substrate 4. Partition wall 6 has a polygonal shape (for example, a rectangular shape), and red, green, and blue phosphor layers 14 (14R, 14G and 14B) are formed on the long, short and connecting portions of the partition wall 6 and the top surface of the dielectric layer 12. That is, the phosphor layers 14 cover the exposed portions of the dielectric layer 12. The phosphor layers 14 also cover the sidewall portions of partition wall 6.

The partition wall 6 can be divided into rectangular units. The rectangular units include a pair of long portions 6*a*, a pair of short portions 6*b*, and connecting portions 6*c* (or corner portions or diagonal portions) disposed between the long and the short portions 6*a* and 6*b*. A discharge space between the phosphor layers 14 formed on the sides of the partition walls 6 and on the dielectric layer 12 on second substrate 4 and the first substrate 2 is injected with the discharge gas (the Ne—Xe mixture gas).

Figure 3:
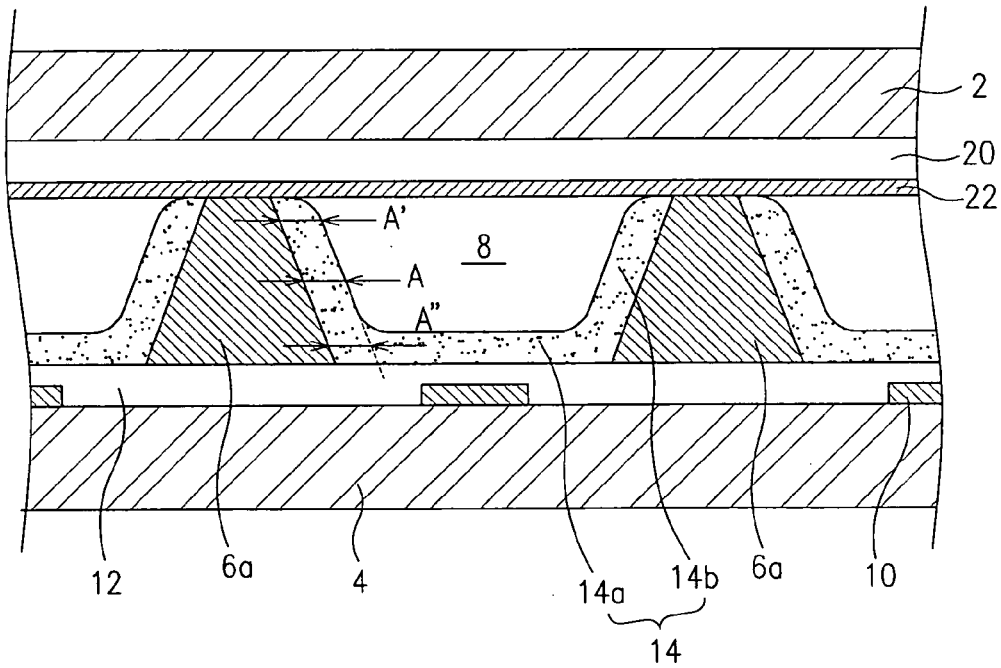
FIG. 3 is a cross-sectional view of the PDP taken along the I-I line of FIG. 2.
Figure 4:
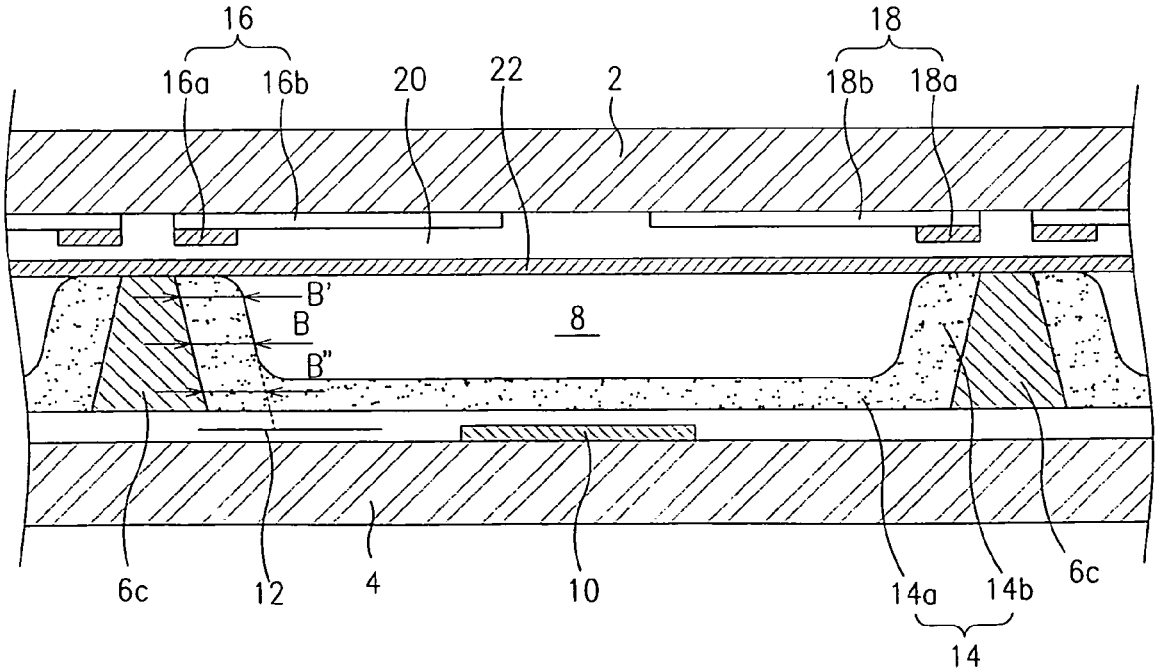
FIG. 4 is a cross-sectional view of the PDP taken along the II-II line of FIG. 2.

Discharge sustain electrodes 16 and 18 are formed on the inner surface of the first substrate 2 and are formed in a +/−x-direction so that they are orthogonal to the address electrodes 10. As illustrated in FIGS. 3 and 4, a transparent dielectric layer 20 and an MgO protective layer 22 are formed on the inner surface of the first substrate 2 and over the discharge sustain electrodes 16 and 18 covering the discharge sustain electrodes 16 and 18.

The discharge sustain electrodes 16 and 18 may be formed with a stripe pattern. Each of the discharge sustain electrodes 16 and 18 can be divided into bus electrodes 16*a* and 18*a* respectively arranged along ends of each discharge cell 8, and a pair of protrusion electrodes 16*b* and 18*b* protruding from the bus electrodes 16*a* and 18*a* toward an inside of each discharge cell 8. Protrusion electrodes 16*b* and 18*b* face each other. The protrusion electrodes 16*b* and 18*b* maybe formed with a transparent conductive material such as indium tin oxide (ITO), and the bus electrodes 16*a* and 18*a* may be formed with an ordinary metallic conductive material.

Address voltages Va are applied to the address electrode 10 and one of the protrusion electrodes 16*b* and 18*b* to select the discharge cell 8 for emitting light. When a sustain voltage is applied between a pair of protrusion electrodes 16*b* and 18*b*, the discharge gas within the discharge cell 8 generates plasma discharge to emit vacuum ultraviolet rays. The vacuum ultraviolet rays then excite the phosphor layer 14 in discharge cell 8 to emit visible rays.

The PDP according to the embodiment of the present invention has a structure where the coat shape and the thickness of the phosphor layer 14 are optimized in consideration with the shape of diffusion of the plasma discharge formed within the discharge cell. As illustrated in the drawings, the phosphor layer 14 is formed on the long, short and connecting portions 6*a*, 6*b* and 6*c* respectively of the partition wall 6 and on the top surface of the dielectric layer 12 with a suitable thickness. In view of the sectional shape of the phosphor layer 14, the phosphor layer 14 may be conveniently divided into a bottom portion 14*a* being the portion of the phosphor layer 14 that is formed on the top surface of the dielectric layer 12, and a wall portion 14*b* being a portion of the phosphor layer 14 formed on the inner sides of the partition wall 6 (i.e., on 6*a*, 6*b* and 6*c*).

The bottom and the wall portions 14*a* and 14*b* of the phosphor layer 14 have the following features. The bottom portion 14*a* of the phosphor layer 14 is positioned closer to the space between the two protrusion electrodes 16*b* and 18*b* than the wall portion 14*b* of the phosphor layer 14. Therefore, it is this middle portion of the bottom portion 14*a* of the phosphor layer 14 that first is exposed to the vacuum ultraviolet light. Therefore, when the plasma discharge is first generated in the space between the two protrusion electrodes 16*b* and 18*b*, the vacuum ultraviolet rays due to the plasma discharge first reaches the middle portion of the bottom portion 14*a* of phosphor layer 14 to initiate the visible light emission in the phosphor layer 14.

The wall portion 14*b* of the phosphor layer 14 is positioned along the periphery of the discharge cell 8. When the plasma discharge is initiated below the space between the two protrusion electrodes 16*b* and 18*b*, the plasma discharge is diffused in the shape of an arc and moves from a center of the discharge cell 8 to the wall portion 14*b*. As a result, visible light is first generated in a middle portion of the bottom portion 14*a* of the phosphor layer and is lastly generated in the wall portion 14*b* of the phosphor layer.

For this reason, in consideration of maximizing the light emission efficiency (T) of the PDP, it becomes important to effectively use the vacuum ultraviolet rays generated within the discharge cell 8 to maximize the light emission efficiency of the phosphors. Particularly in the process where the plasma discharge is diffused in the shape of an arc, it is important to utilize the later-generated vacuum ultraviolet rays in an effective and efficient manner.

Therefore, with the inventive PDP 100, the thickness of the wall portion 14*b* of the phosphor layer 14 directed toward the respective portions (the long and short portions, and the connecting portions 6*a*, 6*b* and 6*c* respectively) of the partition wall 6 as well as the plane shape (or cross-sectional shape) of the internal space 17 surrounded by the wall portion 14*b* are optimized in such a way to best utilize the vacuum ultraviolet rays in an effective manner. For this purpose, the thickness of the wall portion 14*b* of phosphor layer 14 is designed such that the plane shape of the internal space 17 corresponds to the diffusion shape of the plasma discharge. By modifying the thicknesses of the phosphor layer 14 within the discharge cell, the size and the shape of the internal space 17 of the discharge cell is in turn modified for efficient conversion of ultraviolet radiation into visible radiation.

Figure 5:
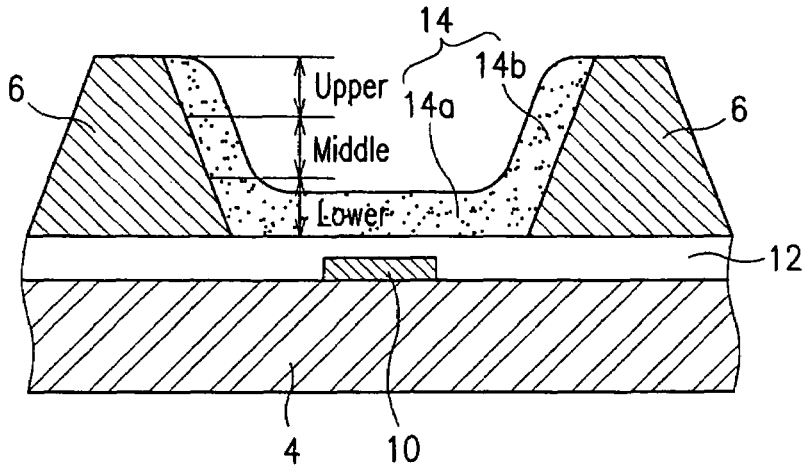
FIG. 5 is a partial amplified view of the PDP illustrated in FIG. 3.
Figure 6:
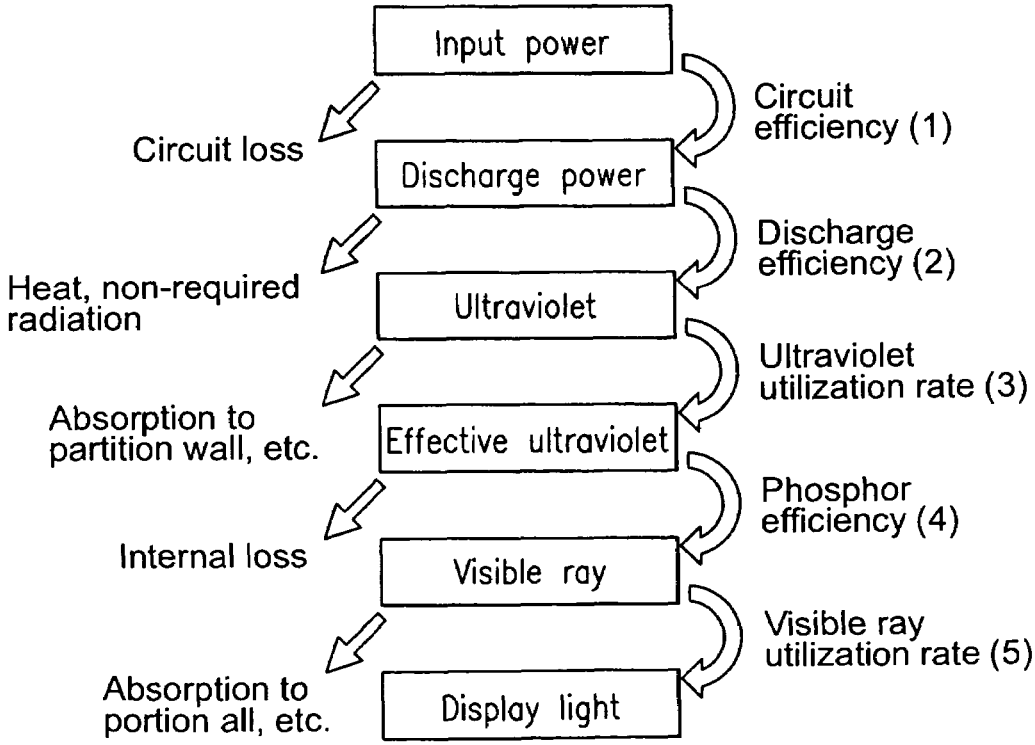
FIG. 6 schematically illustrates the light emission efficiency of a PDP.

More specifically, as illustrated in FIGS. 3, 4, and 5, the wall portion 14*b* is divided into upper, middle, and lower sub-portions in accordance with the heights of the partition wall 6 off the surface of the dielectric layer 12. Assuming that the average thickness of the middle sub-portion of the wall portion 14*b* contacting the long portion 6*a* of the partition wall 6 is indicated by A, and the average thickness of the middle sub-portion of the wall portion 14*b* contacting the diagonal portion 6*c* of the partition wall 6 is indicated by B, the wall portion 14*b* of the phosphor layer 14 is structured to satisfy the following condition:

$$1.5 \leqq B/A \leqq 3.2.$$

As indicated above, when the average thickness B of the middle sub-portion of the wall portion 14*b* contacting the connecting portion 6*c* of the partition wall 6 is formed to be larger than the average thickness A of the middle sub-portion of the wall portion 14*b* contacting the long portion 6*a* of the partition wall 6 by 1.5~3.2 times, the plane shape of the wall portion 14*b* corresponding to at least one of the pairs of portions (in this embodiment, the short portions) among the long and the short portions 6*a* and 6*b* as well as the connecting portions 6*c* is roughly formed with an arc. This corresponds to the diffusion shape of the plasma discharge.

With the manufacturing of the plasma display panel, when the phosphor layer 14 is formed by printing a phosphor paste, the plane shape of the wall portion 14*b* is easily controlled by varying the particle size of phosphor powder and the viscosity of the phosphor paste.

It is preferable to maintain the thickness of the bottom portion 14*a* of the phosphor layer 14 at 9~25 μm. It is further preferable to maintain the average thickness A of the middle sub-portion of the wall portion 14*b* contacting the long portion 6*a* of the partition wall 6 and the average thickness B of the middle sub-portion of the wall portion 14*b* contacting the connecting portion 6*c* of the partition wall 6 at 10~35 μm and 15~60 μm, respectively.

Moreover, the phosphor layer 14 is structured to satisfy the following conditions:

$$1.5 \leqq B'/A' \leqq 3.2,$$

$$1.5 \leqq B''/A'' \leqq 3.2$$

where A' indicates the average thickness of the upper sub-portion of the wall portion 14*b* of the phosphor layer contacting the long portion 6*a* of the partition wall, and B' indicates the average thickness of the upper sub-portion of the wall portion 14*b* of the phosphor layer contacting the connecting portion 6*c* of the partition wall 6 as illustrated in FIGS. 3 and 4.

Furthermore, in the above formula, A" indicates the average thickness of the lower sub-portion of the wall portion 14*b* of the phosphor layer 14 contacting the long portion 6*a* of the partition wall, and B" indicates the average thickness of the lower sub-portion of the wall portion 14*b* of the phosphor layer 14 contacting the connecting portion (or diagonal portion 6*c*) of the partition wall 6 as illustrated in FIGS. 3 and 4.

In addition to the above conditions, it is preferable to maintain the thickness of the bottom portion 14*a* of the phosphor layer 14, the value of A' and A", and the value of B' and B" at 9~25 μm, 10~35 μm, and 15~60 μm, respectively.

Figure 2:
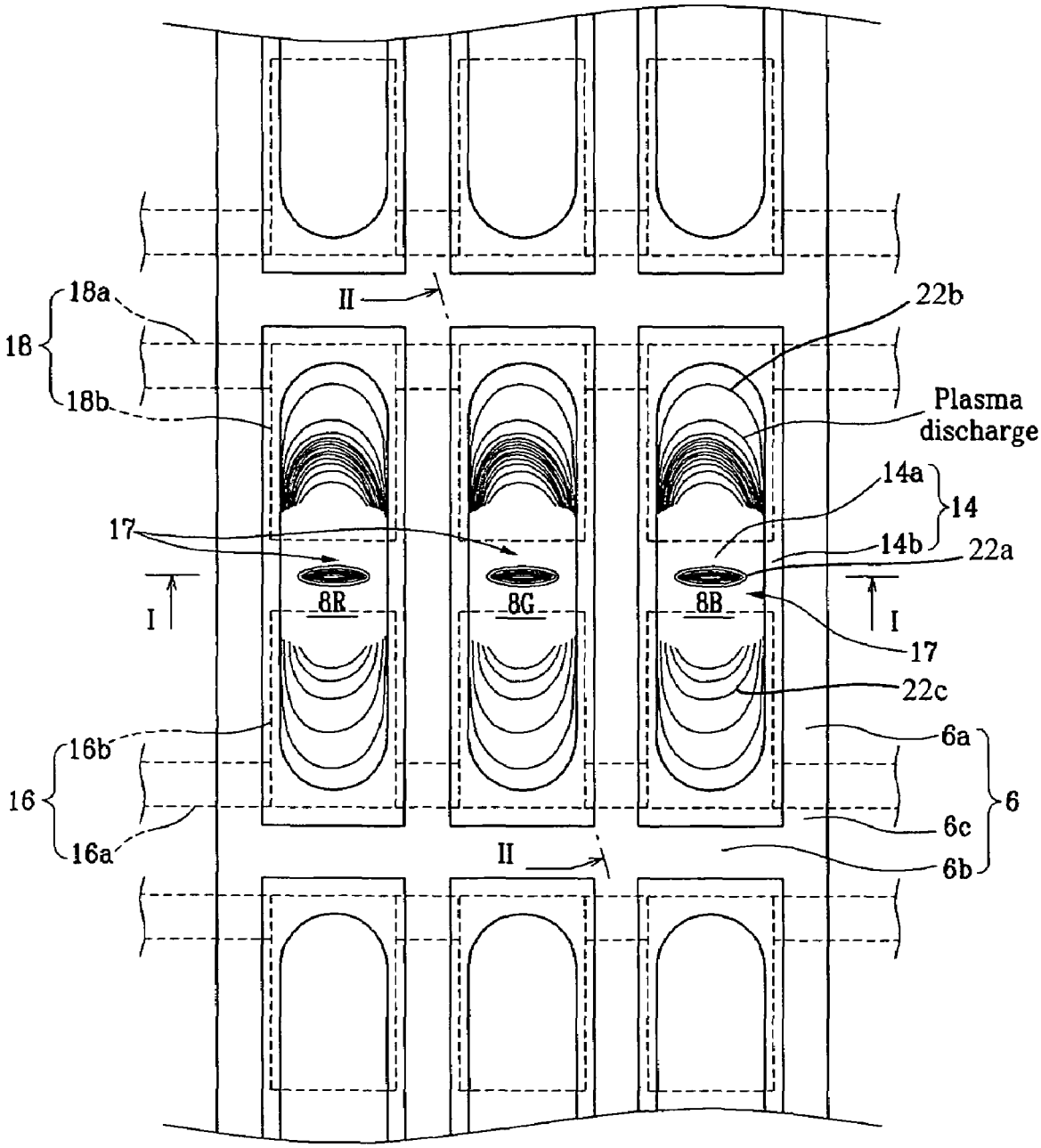
FIG. 2 is a plan view of the PDP illustrated in FIG. 1.

With this inventive structure, the thickness of the respective sub-portions of the wall portion 14*b* of phosphor layer 14 is controlled in the above way so that the plane shape of the internal space 17 surrounded by the wall portion 14*b* has an optimum outline corresponding to the diffusion shape (arc-shape) of the plasma discharge. In operation, when the plasma discharge is initiated from the space between the two protrusion electrodes 16*b* and 18*b* (i.e., reference numeral 22*a* in FIG. 2) and is then diffused in the shape of an arc (reference numeral 22*b* and 22*c* in FIG. 2), the wall portion 14*b* of the phosphor layer 14 is exposed to and energized by the vacuum ultraviolet rays over its wide area, thereby emitting a large amount of visible rays.

Table 1 illustrates empirically relative screen brightnesses and the light emission efficiencies as a function of the ratio B/A for the phosphor layer 14 when the PDP has an effective screen size of 42 inches where the partition walls 6 are closed. The reference brightness when B/A is 1 is assumed to be 100, and the brightness as a function of the ratio B/A is indicated by a relative value. The reference light emission efficiency when the value of B/A is 1 is assumed to be 1, and the light emission efficiency as a function of the ratio B/A is indicated by a relative value.

| | | B/A | Screen brightness | Light emission efficiency |
|---|---|---|---|---|
| Comparative | 1 | 0.5 | 91 | 0.85 |
| Example | 2 | 0.7 | 98 | 0.9 |
| | 3 | 1 | 100 | 1 |
| | 4 | 1.3 | 101 | 1 |
| Example | 1 | 1.5 | 108 | 1.1 |
| | 2 | 2 | 116 | 1.17 |
| | 3 | 2.5 | 114 | 1.15 |
| | 4 | 2.7 | 114 | 1.14 |
| | 5 | 3 | 112 | 1.11 |
| | 6 | 3.2 | 108 | 1.1 |
| Comparative | 5 | 3.5 | 101 | 1 |
| Example | 6 | 4 | 98 | 0.95 |

As illustrated in Table 1, when the ratio B/A is 1.5 or less or when the ratio B/A exceeds 3.2, the relative brightness is relatively poor (101 or less) and the light emission efficiency is also poor (1 or less). In contrast, when the ratio B/A is in the range of 1.5~3.2, the relative brightness well over 101 and can be as high as 116 while the light emission efficiency well in excess of 1.0 and can be as high as 1.17. Therefore, by controlling the ratio B/A and thus by controlling the thickness of the phosphor layer 14, the brightness and the light emission efficiency can be significantly enhanced. Particularly, when the ratio B/A is 2.0, the brightness and the light emission efficiency reach their maximum values. Therefore, it can empirically be known that the optimum value for the ratio B/A is 2.0. When the ratio B/A is 2.0, the light emission efficiency and the brightness are optimized.

As described above, with the PDP according to the embodiment of the present invention, the thickness of the phosphor layer is optimized such that the plane shape of the internal space surround by the wall portion of the phosphor layer corresponds to the diffusion shape of the plasma discharge, thereby maximizing both the screen brightness and the light emission efficiency.

Although preferred embodiments of the present invention have been described in detail hereinabove, it should be clearly understood that many variations and/or modifications of the basic inventive concept herein taught which may appear to those skilled in the art will still fall within the spirit and scope of the present invention, as defined in the appended claims.

What is claimed is:

1. A plasma display panel, comprising:

a first and a second substrates facing each other;

a plurality of address electrodes arranged on the second substrate;

a partition wall arranged between the first and the second substrates to form a plurality of discharge cells between the first and the second substrates, the partition wall separating adjacent discharge cells;

a phosphor layer arranged within each discharge cell;

a plurality of discharge sustain electrodes arranged on the first substrate, wherein the phosphor layer has plane shape including a pair of sides having an arc-shape that corresponds to a diffusion shape of a plasma discharge generated within the discharge cell and;

a dielectric layer formed on a portion of the second substrate and covering the plurality of address electrodes, wherein the partition wall is formed on the dielectric layer, and the plasma display panel comprises discharge cells each defined by the partition wall comprising a pair of long portions, a pair of short portions, and connecting portions arranged between the long portions and the short portions, wherein the phosphor layer is arranged on the long, short and connecting portions of the partition wall and on a top surface of the dielectric layer, wherein the phosphor layer comprises a bottom portion contacting a top surface of the dielectric layer, and a wall portion contacting the long, short and connecting portions of the partition wall, wherein the wall portion of the phosphor layer is structured to satisfy the following condition:

$$1.5 \leqq B/A \leqq 3.2$$

where A indicates an average thickness of a middle sub-portion of the wall portion contacting the long portions of the partition walls, and B indicates an average thickness of a middle sub-portion of the wall portion contacting the connecting portions of the partition walls.

2. The plasma display panel of claim 1, wherein a plane shape of an internal space surrounded by the wall portion within the discharge cell corresponds to the diffusion shape of the plasma discharge generated within the discharge cell.

3. The plasma display panel of claim 2, wherein the plane shape of the wall portion of the phosphor layer corresponds to one of the pairs of the long and short portions of the partition wall and to the connecting portions of the partition wall, the plane shape being substantially an arc-shape.

4. The plasma display panel of claim 1, wherein the thickness of the bottom portion of the phosphor layer is 9~25 μm.

5. The plasma display panel of claim 1, wherein A is in the range of 10~35 μm, and B is the range of 15~60 μm.

6. The plasma display panel of claim 1, wherein the discharge sustain electrodes are formed with a pair of bus electrodes arranged at each discharge cell, and a pair of protrusion electrodes extending from the bus electrodes to the inside of the discharge cell while facing each other.

7. The plasma display panel of claim 6, wherein the bus electrode is arranged within the discharge cell.

8. The plasma display panel of claim 1, further comprising Xe gas arranged within the discharge cells and adapted to produce a plasma discharge upon application of electricity to the discharge sustain electrodes.

9. The plasma display panel of claim 1, wherein the partition wall is arranged in a grid-like arrangement resulting in ones of the discharge cells having rectangular-shapes, each rectangular-shaped discharge cell having two short sides, two long sides, and four corners.

10. The plasma display panel of claim 1, wherein the phosphor layer has a cross-sectional shape with inclined sides between the first and second substrates.

11. A plasma display panel, comprising:

a first substrate having a first plurality of electrodes formed thereon;

a second substrate having a second plurality of electrodes formed thereon;

a partition wall arranged between the first and the second substrates to form a plurality of discharge cells between the first and the second substrates, the partition wall separating adjacent discharge cells; and a phosphor layer arranged within each discharge cell, the phosphor layer comprising a pair of long portions, a pair of short portions, and connecting portions arranged between ones of the long portions and ones of the short portions, wherein a thickness of the connecting portions of the phosphor layer is thicker than a thickness of the long portions of the phosphor layer that corresponds to a diffusion shape of the plasma discharge generated within the discharge cell.

12. The plasma display panel of claim 11, the phosphor layer being formed on a bottom of each discharge cell and on sidewalls of the partition walls in each discharge cell.

13. The plasma display panel of claim 12, the thickness of the phosphor layer on the bottom of the discharge cell is in the range of 9 to 25 microns and the thickness of the phosphor layer on the sidewalls of the partition walls is in the range of 15 to 60 microns.

14. The plasma display panel of claim 11, the partition walls being arranged in a grid-like arrangement producing rectangular-shaped discharge cells, each rectangular-shaped discharge cell having a two short sides and two long sides and four corners.

15. The plasma display panel of claim 14, the ratio of the thickness of the phosphor layer in one of the four corners on the partition walls is between 1.5 to 3.2 times the thickness of the phosphor layer in a middle of one of the sides on the partition walls away from the corners.

16. The plasma display panel of claim 14, the ratio of the thickness of the phosphor layer in one of the four corners of the partition walls is 2.0 times the thickness of the phosphor layer in a middle of one of the sides of the partition walls away from the corners.

17. The plasma display panel of claim 11, the discharge cells being filled with Xe gas adapted to form a plasma discharge when electricity is applied.

18. The plasma display panel of claim 11, the thickness profile of the phosphor layer in the discharge cells is designed to match the arc-shaped profile of a diffusing plasma discharge.

19. A plasma display panel, comprising:

a first and a second substrate facing each other;

a plurality of address electrodes arranged on the second substrate;

a partition wall arranged between the first and the second substrates and adapted to form a plurality of discharge cells between the first and the second substrates, the partition wall separating adjacent ones of the plurality of discharge cells;

a dielectric layer arranged on a portion of the second substrate and covering the plurality of address electrodes; and a phosphor layer arranged within each discharge cell, wherein the partition wall is arranged on the dielectric layer, the plasma display panel comprising the discharge cells, each discharge cell defined by the partition wall that comprises a pair of long portions, a pair of short portions, and connecting portions arranged between ones of the long portions and ones of the short portions, the phosphor layer being arranged on the long, short, and connecting portions of the partition wall and on a top surface of the dielectric layer, the phosphor layer comprising a bottom portion contacting the top surface of the dielectric layer, and a wall portion contacting the long, short, and connecting portions of the partition wall, and the wall portion of the phosphor layer being structured to satisfy the following condition $$1.5 \leqq B/A \leqq 3.2$$

where A indicates an average thickness of a middle sub-portion of the wall portion of the phosphor layer contacting the long portions of the partition wall, and B indicates an average thickness of a middle sub-portion of the wall portion of the phosphor layer contacting the connecting portions of the partition wall.

* * * * *